United States Patent [19]

Clapper

[11] 4,162,965

[45] Jul. 31, 1979

[54] PROCESS FOR THE REMOVAL OF SOLID PARTICULATE MATERIALS FROM CRUDE SHALE OILS

[75] Inventor: Thomas W. Clapper, Oklahoma City, Okla.

[73] Assignee: Kerr-McGee Corporation, Oklahoma City, Okla.

[21] Appl. No.: 914,900

[22] Filed: Jun. 7, 1978

[51] Int. Cl.[2] ..... C10G 21/00

[52] U.S. Cl. ..... 208/177

[58] Field of Search ..... 208/177, 251 R, 11 R, 208/11 LE; 210/73 R

[56] References Cited

U.S. PATENT DOCUMENTS

| | | | |
|---|---|---|---|
| 3,527,692 | 9/1970 | Titus | 208/11 LE |
| 3,607,721 | 9/1971 | Nagy | 208/11 LE |

FOREIGN PATENT DOCUMENTS

| | | | |
|---|---|---|---|
| 2504488 | 8/1976 | Fed. Rep. of Germany | 208/177 |

*Primary Examiner*—George Crasanakis
*Attorney, Agent, or Firm*—William G. Addison

[57] ABSTRACT

This invention relates to a process for removing finely divided insoluble particulate materials from crude shale oils. A feed comprising crude shale oil that contains insoluble particulate material is mixed with a solvent and thereafter separated in a first separation zone into a first light fraction comprising the crude shale oil and the solvent and a first heavy fraction comprising the insoluble particulate material, some crude shale oil and some dissolving solvent. The first light fraction then is withdrawn and subjected to a second separation in a second separation zone. In the second separation zone, the first light fraction is separated into a plurality of fractions of crude shale oil and solvent. The crude shale oil fractions then are separated, withdrawn and subjected to subsequent hydrorefining, while the solvent is recovered and recycled to provide additional feed mixture.

17 Claims, 1 Drawing Figure

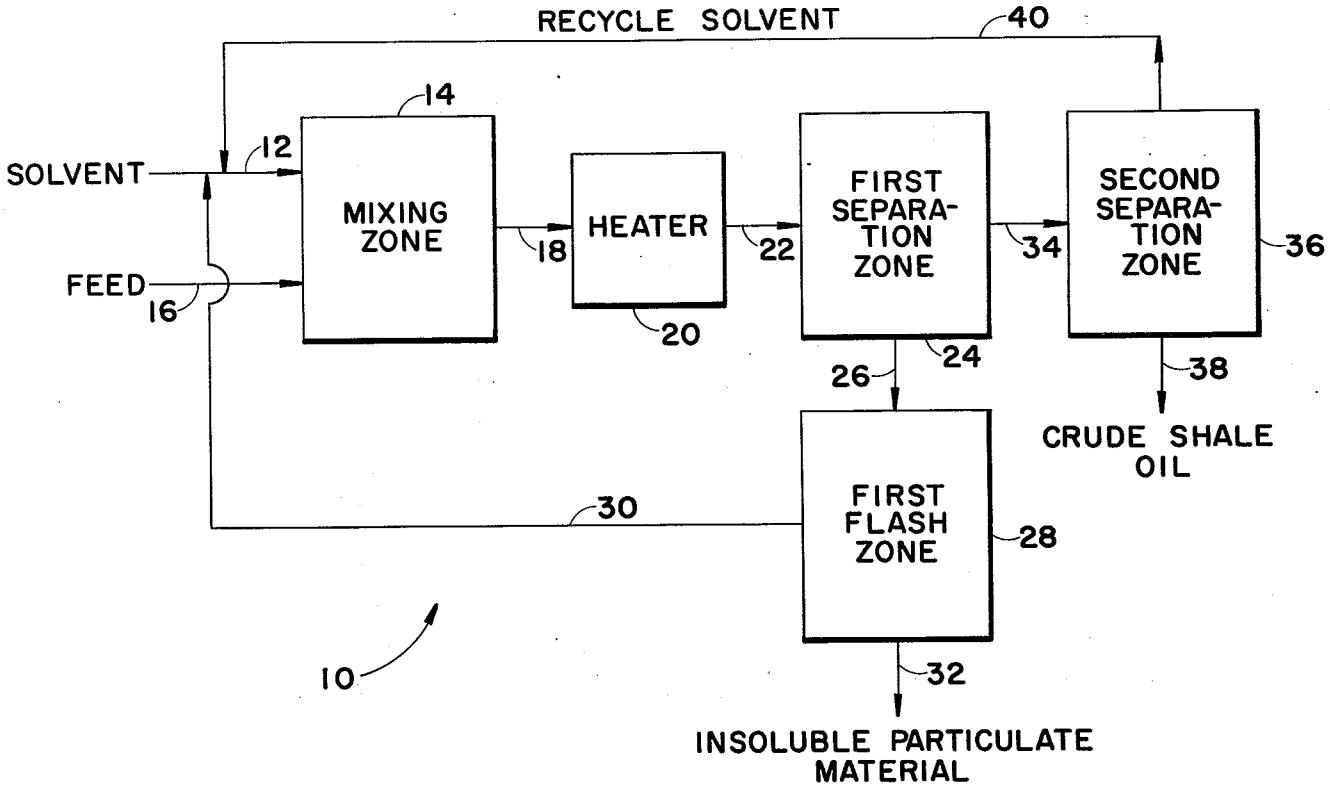
SECOND SEPARA-TION ZONE
36
38
CRUDE SHALE OIL
40
34
FIRST SEPARA-TION ZONE
24
26
FIRST FLASH ZONE
28
32
INSOLUBLE PARTICULATE MATERIAL
RECYCLE SOLVENT
22
HEATER
20
30
18
MIXING ZONE
14
10
12
16
SOLVENT
FEED

PROCESS FOR THE REMOVAL OF SOLID PARTICULATE MATERIALS FROM CRUDE SHALE OILS

BACKGROUND OF THE INVENTION

1. Field of the Invention

This invention relates to the refining of shale oils containing finely divided insoluble particulate materials. In particular, this invention relates to a process for refining shale oils which includes a preliminary solvent treatment to substantially remove insoluble particulate materials including organometallic compounds, asphaltenes and the like before hydrorefining of said oils.

2. Brief Description of the Prior Art

In general, crude shale oil produced, for example, by the Paraho process or other eduction processes, is not as susceptible to the same refining methods as petroleum oils, at least with any degree of practicality, because of the high impurities content which causes fouling and plugging of the hydrorefining unit.

In the past, the two general approaches used to fractionate or upgrade crude shale oil for hydrorefining have been hydrotreating or coking.

When the shale oil is fractionated by hydrotreating, the finely divided solids collect in the tower bottoms. These bottoms then must be subjected to centrifugation or to filtration, both of which processes involve high capital investments and high operating expenses to remove the undesirable solids.

In the alternative approach of coking, the heavy bottoms are fed to a coker where the solids are removed as a clean cake and the coker distillate is combined with overhead cuts and subsequently hydrorefined. However, this method sacrifices otherwise recoverable crude shale oil and thus does not provide as economically acceptable a process as would be desirable.

Thus, it is desirable to provide a simple and more economical process for treating shale oils to remove the finely divided insoluble particulate material.

SUMMARY OF THE INVENTION

The surprising discovery now has been made that the process to be hereinafter described provides a simpler, more economical means of removing the finely divided insoluble particulate material from the crude shale oil than heretofore possible.

In the practice of this invention, a feed comprising crude shale oil that contains insoluble particulate material is contacted and mixed with a solvent in a mixing zone after which the feed mixture is subjected to separation in a first separation zone maintained at an elevated temperature and pressure to effect the separation of the feed.

In the first separation zone, the feed mixture separates into a first light fraction comprising the crude shale oil and dissolving solvent and a first heavy fraction comprising the insoluble particulate material, some solvent and some crude oil shale. The first light fraction is withdrawn and subjected to a second separation in a second separation zone maintained at an elevated temperature and pressure to effect the second separation.

In the second separation zone, the first light fraction separates into a second light fraction comprising the solvent and a second heavy fraction comprising the crude shale oil. The second light fraction then is recycled to contact additional feed material and the second heavy fraction is withdrawn and subjected to subsequent hydrorefining. Alternatively, the first light fraction can be subjected to a series of separations to provide a plurality of crude shale oil fractions which then are recovered and subjected to hydrorefining.

BRIEF DESCRIPTION OF THE DRAWING

The single FIGURE is a diagrammatic, schematic illustration of the process of this invention.

DESCRIPTION OF THE PREFERRED EMBODIMENT

Turning now to the single FIGURE, general reference numeral 10 illustrates a process arranged in accordance with one embodiment of the present invention for the substantial removal of insoluble particulate material and other undesirable materials associated with crude oil shale produced, for example, by the Paraho process or any other eduction process. In general, a feed comprising crude shale oil containing insoluble particulate material is contacted with a solvent and processed through the system to produce an upgraded crude shale oil for subsequent hydrorefining.

Referring more particularly to the drawing, a solvent is passed from a solvent surge vessel (not shown) through a conduit 12 to enter a mixing zone 14 at a rate controlled by a valve (not shown) interposed in the conduit 12.

Crude shale oil containing insoluble particulate material, hereinafter referred to as the "feed," is contained in a feed storage vessel (not shown) and is passed by a pump (not shown) through a conduit 16 to enter mixing zone 14 at a rate controlled by a valve (not shown) interposed in conduit 16.

The feed rates of the solvent and feed preferably are controlled to maintain the weight ratio of solvent to feed in a range of from about one-to-one to about ten-to-one within the mixing zone 14. More particularly, it is desirable to maintain the weight ratio of solvent to feed in a range of from about two-to-one to about five-to-one.

In mixing zone 14, the feed and solvent are contacted and mixed at about ambient temperature and pressure to form a feed mixture. The feed mixture is withdrawn from mixing zone 14 via a conduit 18 by a pump (not shown) to enter a heater 20.

In heater 20, the feed mixture is heated to a temperature level in the range of from about 400 degrees F. to about 750 degrees F. and a pressure level in the range of from about 500 psig to about 2000 psig. The heated feed mixture then is withdrawn from heater 20 and enters a first separation zone 24 via a conduit 22.

In this particular embodiment, the first separation zone 24 is maintained at a temperature level in the range of from about 400 degrees F. to about 750 degrees F. and a pressure level in the range of from about 500 psig to about 2000 psig to effect a separation of the feed mixture therein.

In the first separation zone 24, the heated feed mixture separates into a first light fraction comprising the solvent and crude shale oil and a first heavy fraction comprising the insoluble particulate material, some solvent and some crude shale oil.

The separated first heavy fraction then is withdrawn from the first separation zone 24 via a conduit 26. In one preferred embodiment, the first heavy fraction withdrawn via conduit 26 enters a first flash zone 28.

In flash zone 28, which comprises a flash vessel of any suitable design, the first heavy fraction is flashed to produce at least one stream comprising the insoluble particulate material and one other overhead stream comprising the solvent and some crude shale oil.

The overhead stream is withdrawn from flash zone 28 via a conduit 30 for recycle to the mixing zone 14 to contact additional feed and thereby aid in providing additional feed mixture.

The insoluble particulate material is withdrawn from flash zone 28 via a conduit 32.

The first light fraction separated in the first separation zone 24 is withdrawn via a conduit 34 to enter a second separation zone 36.

In this particular embodiment, the second separation zone 36 is maintained at a temperature level in the range of from about 600 degrees F. to about 900 degrees F. and a pressure level in the range of from about 490 psig to about 1990 psig to effect a separation of the first light fraction into a second light fraction comprising the dissolving solvent and a second heavy fraction comprising the crude shale oil. The heating may be effected, for example, by a heater (not shown) interposed in conduit 34.

The second light fraction, separated in the second separation zone 36 is withdrawn via a conduit 40. The withdrawn second light fraction can be recycled to conduit 12 to enter mixing zone 14 to aid in providing the feed mixture to the process.

The second heavy fraction, comprising the crude shale oil, separated in the second separation zone 36, is withdrawn via a conduit 38. The withdrawn second heavy fraction then is passed to subsequent hydrorefining apparatus (not shown) of the type well known by those skilled in the art to recover various hydrocarbon fractions.

In an alternate embodiment, second separation zone 36 can comprise a pressure reduction and temperature treatment zone to recover the solvent from the first light fraction by pressure reduction and heat recovery methods well known to those skilled in the art, such as via flashing.

In yet another alternate embodiment, second separation zone 36 can comprise a series of separation vessels such that a plurality of various shale oil fractions can be produced for use as feed materials to subsequent hydrorefining processes. Further, the solvent can be recovered as previously indicated and recycled to aid in providing additional feed mixture.

Thus, the practice of this invention results in the production of a crude shale oil product suitable for conventional petroleum hydrorefining in that the solids content of the finely divided insoluble particulate material present in the raw shale oil from the eduction process is reduced to less than 0.5 percent by weight. In some instances, the insoluble particulate content may be reduced to less than 0.1 percent be weight. The reduction in solids content reduces the possibility of fouling or plugging of the hydrorefining equipment, and yields a crude shale oil product containing approximately 1.0 percent or less of ramsbottom carbon, thereby indicating a reduction in the probable coking tendency of the shale oil during hydrorefining. Further, the removal of the finely divided particulate solids also results in a reduction in the metals content of the crude shale oil through removal of a small amount of the high molecular weight organic compounds with which the metals are associated and which are separated with the insoluble particulate material. The reduction in metals content has the beneficial effect of extending the operating life of the hydrorefining catalyst, thereby reducing downtime required for catalyst regeneration thereby providing a much more economical process.

The term "solvent" as used herein means those light organic solvents having critical temperatures below 800 degrees F. and preferably below 750 degrees F. Suitable solvents comprise one or more substances selected from the following groups:

1. Hydrocarbons:

a. Aromatic hydrocarbons having a single benzene nucleus and preferably six to nine carbon atoms, such as benzene, toluene, o-, m-, and p-xylene, ethyl benzene, n-propyl or isopropyl benzene, and monocyclic aromatic hydrocarbons in general having normal boiling points below about 310° F., and b. Cycloparaffin hydrocarbons which preferably contain four to nine carbon atoms such as cyclobutane, cyclopentane, cyclohexane, cycloheptane, and nonaromatic monocyclic hydrocarbons in general having normal boiling points below about 310° F.

2. Open chain hydrocarbons:

a. Open chain mono-olefin hydrocarbons having normal boiling points below about 310° F. and preferably containing about four to seven carbon atoms, such as butene, pentene, hexene, and heptene, and b. Open chain saturated hydrocarbons having normal boiling points below about 310° F. and preferably containing about five to eight carbon atoms such as pentane, hexane, heptane, and octane.

3. Amines, including the following:

a. Mono-, di-, and tri-open chain amines which preferably contain about two to eight carbon atoms such as ethyl, propyl, butyl, pentyl, hexyl, heptyl, and octyl amines;

b. Carbocyclic amines having a monocyclic structure and preferably containing approximately six to nine carbon atoms, such as aniline and its lower alkyl homologs wherein the alkyl groups contain about one to three carbon atoms and up to three alkyl groups are present on each monocarbocyclic structure; and c. Heterocyclic amines preferably those amines containing about five to nine carbon atoms such as pyridine and its lower alkyl homologs wherein the alkyl groups contain approximately one to four carbon atoms and up to three alkyl groups are present on each heterocyclic structure.

4. Phenol and its lower alkyl homologs, and preferably phenols having six to nine carbon atoms. The alkyl groups may contain, for example, one to three carbon atoms and up to three alkyl groups may be present on each phenolic nucleus.

The term "insoluble particulate material" as used herein means those inorganic materials, solid or semisolid organic materials, asphaltenes and the like present in a crude shale oil produced by an eduction process as well as those high molecular weight organic compounds present in the education product which are associated with metallic elements.

The process of this invention is further illustrated by the following Examples, which are set forth for purposes of illustration only and not limitation.

EXAMPLE 1

A feed mixture is prepared by mixing a feed comprising crude shale oil containing insoluble particulate material recovered as the product of the Paraho process for shale eduction with a solvent (comprising benzene) in a ratio of one part by weight of feed to about three parts by weight of benzene. The feed portion of the feed mixture so prepared was analyzed and found to have the analyses set forth in Table 1, below.

TABLE 1

| | |
|---|---|
| Gravity, °API | 21.3 |
| Viscosity, SUS 130° | 90 |
| Proximate Analysis | |
| % Ramsbottom carbon | 2.2 |
| % Ash | 1.5 |
| Nickel, ppm | 6 |
| Vanadium, ppm | 3 |
| Arsenic, ppm, | 40 |
| Ultimate analysis | |
| % Carbon | 84.6 |
| % Hydrogen | 11.4 |
| % Nitrogen | 1.7 |
| % Sulfur | 0.8 |
| % Oxygen (by difference) | 2.5 |

The feed mixture is heated to a temperature of about 525 degrees F. and a pressure of about 850 psig. The heated feed mixture is introduced into a separation vessel wherein the temperature and pressure are maintained constant. The feed mixture separates into two fluid-like phases, a light phase and a heavy phase. A portion of the light phase is withdrawn from the separation vessel and treated to recover the crude shale oil. The crude shale oil is found to contain about 0.1 percent by weight of insoluble particulate material and less than 0.9 percent ramsbottom carbon.

EXAMPLE 2

A feed mixture is prepared as in Example 1 using pyridine as the solvent in a ratio of one part by weight of feed to about 10 parts by weight of pyridine. The feed mixture is heated and introduced into the separation vessel wherein it is maintained at a temperature of about 650 degrees F. and a pressure of about 950 psig. The feed mixture separates into two fluid-like phases and a portion of the light phase is removed and treated to recover the crude shale oil. The crude shale oil is found to contain about 0.2 percent by weight of insoluble particulate material and less than 1.1 percent ramsbottom carbon.

While the present invention has been described with regard to what at present are considered to be the preferred embodiments thereof, it is to be understood that changes or modifications of the process and apparatus described herein can be made without departing from the spirit or scope of the invention as defined by the following claims.

What is claimed is:

1. A process for reducing the insoluble particulate material content in crude shale oil produced by eduction of oil-bearing shale deposits, comprising:
   - admixing crude shale oil containing insoluble particulate material with a solvent to provide a feed mixture;
   - introducing said feed mixture into a first separation zone;
   - maintaining said first separation zone at a temperature level in the range of from about 400 degrees F. to about 750 degrees F. and a pressure level in the range of from about 500 psig to about 2000 psig to separate said feed mixture in said first separation zone into a first light fraction comprising crude shale oil and solvent and a first heavy fraction comprising insoluble particulate material, some solvent and some crude shale oil;
   - withdrawing said first heavy fraction separated in said first separation zone; and
   - withdrawing said first light fraction separated in said first separation zone.

2. The process of claim 1 defined further to include the steps of:
   - introducing the withdrawn first light fraction into a second separation zone;
   - separating the first light fraction in the second separation zone into a second light fraction comprising solvent and a second heavy fraction comprising crude shale oil;
   - withdrawing the second light fraction from the second separation zone; and
   - withdrawing the second heavy fraction from the second separation zone.

3. The process of claim 2 defined further to include the step of:
   - passing the withdrawn second light fraction back to said admixing to provide additional feed mixture.

4. The process of claim 2 defined further to include the steps of:
   - maintaining the second separation zone at a temperature level in the range of from about 600 degrees F. to about 900 degrees F. and a pressure level in the range of from about 490 psig to about 1990 psig to separate the first light fraction therein.

5. The process of claim 1 defined further to include the steps of:
   - introducing the withdrawn first light fraction into a pressure reduction and temperature treatment zone to flash the first light fraction to form at least one stream comprising crude shale oil and one other stream comprising solvent:
   - withdrawing the solvent stream; and
   - withdrawing said at least one stream comprising crude shale oil.

6. The process of claim 5 defined further to include the step of:
   - recycling said withdrawn solvent stream to admix with additional crude shale oil containing insoluble particulate material to provide additional feed mixture.

7. The process of claim 1 defined further as:
   - admixing said solvent with crude shale oil containing insoluble particulate material in a ratio in the range of from about one-to one to about ten-to-one to provide the feed mixture.

8. The process of claim 1 defined further as:
   - admixing said solvent with said crude shale oil containing insoluble particulate material in a ratio in the range of from about two-to-one to about five-to-one.

9. The process of claim 2 defined further to include the steps of:
   - flashing said withdrawn fractions from said second separation zone to separate at least one stream comprising crude shale oil from each fraction;
   - withdrawing said separated stream comprising crude shale oil from said flashing; and
   - recycling the remainder of the fractions after withdrawing said separated crude shale oil stream to admix with additional crude shale oil containing insoluble particulate material to provide additional feed mixture.

10. A process for the substantial removal of insoluble particulate material present in crude shale oil produced by eduction of oil-bearing shale deposits, comprising:

admixing crude shale oil containing insoluble particulate material with a predetermined amount of a solvent such that the ratio of said solvent to said crude shale oil is in the range of from about one-to-one to about ten-to one to provide a feed mixture;

introducing said feed mixture into a first separation zone;

maintaining said first separation zone at a temperature level the range of from about 400 degrees F. to about 750 degrees F. and a pressure level in the range of from about 500 psig to about 2000 psig to separate said feed mixture in said first separation zone into a first light fraction comprising solvent and crude shale oil and a first heavy fraction comprising insoluble particulate material, some solvent and some crude shale oil;

withdrawing said first heavy fraction from said first separation zone; and withdrawing said first light fraction from said first separation zone.

11. The process of claim 10 defined further to include the steps of:

introducing the withdrawn first light fraction into a second separation zone;

separating the first light fraction in the second separation zone into a second light fraction comprising solvent and a second heavy fraction comprising crude shale oil;

withdrawing the second light fraction from the second separation zone; and withdrawing the second heavy fraction from the second separation zone.

12. The process of claim 11 defined further to include the step of:

recycling said withdrawn second light fraction to admix with additional crude shale oil containing insoluble particulate material to provide additional feed mixture.

13. The process of claim 11 defined further to include the steps of:

maintaining the second separation zone at a temperature level in the range of from about 600 degrees F. to about 900 degrees F. and a pressure level in the range of from about 490 psig to about 1990 psig to separate the first light fraction therein.

14. The process of claim 10 defined further to include the steps of:

introducing the withdrawn first light fraction into a pressure reduction and temperature treatment zone to flash the first light fraction to form at least one stream comprising crude shale oil and one other stream comprising solvent;

withdrawing the solvent stream; and withdrawing said at least one stream comprising crude shale oil.

15. The process of claim 14 defined further to include the step of:

recycling said withdrawn solvent stream to admix with additional crude shale oil containing insoluble particulate material to provide additional feed mixture.

16. The process of claim 11 defined further to include the steps of:

flashing said withdrawn fractions from said second separation zone to separate at least one stream comprising crude shale oil from each fraction;

withdrawing said separated stream comprising crude shale oil from said flashing; and recycling the remainder of the fractions after withdrawing said separated crude shale oil stream to admix with additional crude shale oil containing insoluble particulate material to provide additional feed mixture.

17. The process of claim 10 wherein the ratio of solvent to crude shale oil containing insoluble particulate material is in the range of from about two-to-one to about five-to-one.

* * * * *